US006641247B2

(12) United States Patent
Ide et al.

(10) Patent No.: US 6,641,247 B2
(45) Date of Patent: Nov. 4, 2003

(54) LIQUID DISCHARGING APPARATUS AND DISCHARGE RECOVERING METHOD THEREFOR

(75) Inventors: Daisaku Ide, Tokyo (JP); Hiroyuki Kigami, Kanagawa (JP); Tetsuhiro Nitta, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/994,735

(22) Filed: Nov. 28, 2001

(65) Prior Publication Data

US 2002/0067387 A1 Jun. 6, 2002

(30) Foreign Application Priority Data

Nov. 30, 2000 (JP) ..... 2000/364721

(51) Int. Cl.[7] ..... B41J 2/165
(52) U.S. Cl. ..... 347/23; 347/30
(58) Field of Search ..... 347/23, 29, 30, 347/33, 14, 86, 7, 19

(56) References Cited

U.S. PATENT DOCUMENTS 6,086,183 A * 7/2000 Nakahara ..... 347/30

FOREIGN PATENT DOCUMENTS

EP 0 698 495 A2 * 2/1996

* cited by examiner

*Primary Examiner*—Shih-wen Hsieh
(74) *Attorney, Agent, or Firm*—Fitzpatrick, Cella, Harper & Scinto

(57) ABSTRACT

A liquid discharging apparatus characterized by a mounting portion for mounting thereon a liquid discharging head provided with a discharge port for discharging liquid, a cap for covering the discharge port, suction means for effecting suction from the discharge port when the cap covers the discharge port, and control means for causing the cap to cover the discharge port when the liquid discharging head is mounted on the mounting portion, and causing the suction means to effect first suction from the discharge port by negative pressure having a first negative pressure curve, and then causing the suction means to effect second suction from the discharge port by negative pressure in a second negative pressure curve which is different than the first negative pressure curve with the cap caused to cover the discharge port.

9 Claims, 6 Drawing Sheets

LIQUID DISCHARGING APPARATUS AND DISCHARGE RECOVERING METHOD THEREFOR

BACKGROUND OF THE INVENTION

1. Field of the Invention

This invention relates to a liquid discharging apparatus such as an ink jet recording apparatus and a discharge recovering method therefor.

2. Related Background Art

Liquid discharging apparatus such as ink jet recording apparatus for executing recording by discharging ink toward a recording medium (recording material) such as paper cloth a plastic sheet or an OHP sheet on the basis of image information (recording information) spread as recording apparatuses having the functions of printers, copiers and facsimile apparatuses, or recording apparatuses (printing apparatuses) used as the output apparatuses of compound type electronic apparatuses including computers, word processors, etc. and work stations or the like. Also, there are various requirements for the qualities of these recording mediums, and in recent years, development for these requirements have been advanced, and use has also been made of liquid discharging apparatuses using, as recording mediums, paper (including thin paper and processed paper) which is an ordinary recording mediums and resin thin sheets (such as OHP sheets) and in addition, cloth, leather, nonwoven fabric and further, metals or the like.

The aforedescribed liquid discharging apparatuses (such as ink jet recording apparatuses) are widely applied to printers, copiers, facsimile apparatuses, etc. from the viewpoints of low noise, low running cost, ease of downsizing, ease of coloring, etc. Discharge ports (usually plural) for discharging liquid droplets (such as ink droplets) are formed in the front face of the liquid discharge head (such as ink jet recording head) of the liquid discharging apparatus, and the size of the discharge ports is of the order of several tens of microns, but recently, with a higher quality of image, the size of the discharge ports has been becoming smaller and smaller. Liquid droplets are discharged from the discharge ports on the basis of a discharge signal processed in the apparatus on the basis of liquid droplet discharge information (such as recording data) sent from a host apparatus, whereby an image (including characters and symbols) is formed on a recording medium.

In the above-described ink jet recording apparatuses for effecting recording by discharging ink from recording means to the recording medium, the ink is discharged from the minute discharge ports to thereby effect recording and therefore, clogging may occur to the discharge ports and the quality of recorded images may lower due to bad discharge (including non-discharge) and as a countermeasure therefor, it is practised to use a recovery unit for maintaining and recovering the ink discharging performance of the recording means. As this recovery unit, use is made, for example, one provided with a capping mechanism for capping the discharge ports of the recording head, suction means connected to the capping mechanism in its capping state and operating a pump to thereby generate negative pressure in the capping mechanism and suck and discharge foreign materials such as viscosity-increased ink and bubbles from the discharge ports and thereby refresh the ink in the discharge ports to thereby maintain and recover the ink discharging performance, and wiping means for wiping off foreign materials such as ink adhering to the surface of the discharge ports of the recording means.

On the other hand, in the above-described ink jet recording apparatus as the liquid discharging apparatus, in order to prevent desiccation during shipment, the interior of an ink jet head as a liquid discharging head is filled with liquid (e.g. clear ink containing no coloring material), and the technique of performing the cleaning operation (a kind of discharge recovering operation) for drawing out the aforementioned liquid to render recording (image formation) possible when the ink jet head is mounted on the ink jet recording apparatus for the first time is applied.

However, it has sometimes been the case that when the cleaning operation (recovering operation) during ordinary use is easily used to perform the cleaning operation for drawing out the liquid, impurities dissolved in the liquid (for example, additives or the like dissolved from liquid contacting materials such as a sealant and an adhesive agent) filling the head due to the severe environment during shipment are rubbed against the discharge port surface of the liquid discharging head (ink jet head) during the wiping operation in a series of cleaning operations, and the quality of a recorded image (including characters and symbols) is degraded by those impurities adhering to the ink discharging portion.

SUMMARY OF THE INVENTION

The present invention intends to perform a second suction pump operation after a first suction pump operation in initial cleaning effected to render a new head mounted on a liquid discharging apparatus for the first time capable of recording when the head is used, to thereby achieve the optionization of the cleaning operation by the first suction pump operation and thereby solve the above-noted technical problem. That is, it is an object of the present invention to provide a liquid discharging apparatus and a discharge recovering method therefor in which the optimization of the condition of the suction recovery operation can be achieved in conformity with the purpose of the initial cleaning to thereby minimize the consumption of liquid and yet minimize the time for which and the amount by which the liquid containing impurities touches the surface of discharge ports, whereby a liquid discharging head can be early and reliably subjected to the initial cleaning.

A liquid discharging apparatus according to the present invention is characterized by a mounting portion for mounting thereon a liquid discharging head provided with a discharge port for discharging liquid therethrough, a cap for covering the discharge port, suction means for effecting suction from the discharge port when the cap covers the discharge port, and control means for causing the cap to cover the discharge port when the liquid discharging head is mounted on the mounting portion, and causing the suction means, in this state, to effect first suction for effecting suction from the discharge port by negative pressure having a first negative pressure curve indicative of the relation between the negative pressure in the cap for suction and the time elapsed, and then causing the suction means to effect second suction for effecting suction from the discharge port by negative pressure in a second negative pressure curve small in the frequency of occurrence of the peak of the negative pressure per unit time as compared with the first negative pressure curve with the cap caused to cover the discharge port. According to such a liquid discharging apparatus of the present invention, the optimization of the condition of the suction recovering operation during the initial cleaning of the liquid discharging head can be achieved to thereby minimize the consumption of the liquid and yet minimize the time for which and the amount by which the liquid containing impurities touches the surface of the discharge port, whereby the liquid discharging head can be early and reliably subjected to the initial cleaning.

A discharge recovering method for a liquid discharging apparatus according to the present invention is characterized by the first sucking step of effecting, when a liquid discharging head provided with a discharge port for discharging liquid therethrough is mounted on a mounting portion for mounting the liquid discharging head thereon, suction from the discharge port by negative pressure in a first negative pressure curve indicative of the relation between the negative pressure in a cap for suction and the time elapsed with the cap covering the discharge port, and the second sucking step of effecting, after the first sucking step, suction from the discharge port by negative pressure having a second negative pressure curve small in the frequency of occurrence of the peak of the negative pressure per unit time as compared with the first negative pressure curve with the discharge port covered with the cap. According to such a discharge recovering method of the present invention, the optimization of the condition of the suction recovering operation during the initial cleaning of the liquid discharging head can be achieved to thereby minimize the consumption of the liquid and yet minimize the time for which and the amount by which the liquid containing impurities touches the surface of the discharge port, whereby the liquid discharging head can be early and reliably subjected to initial cleaning.

DESCRIPTION OF THE PREFERRED EMBODIMENTS

Figure 1:
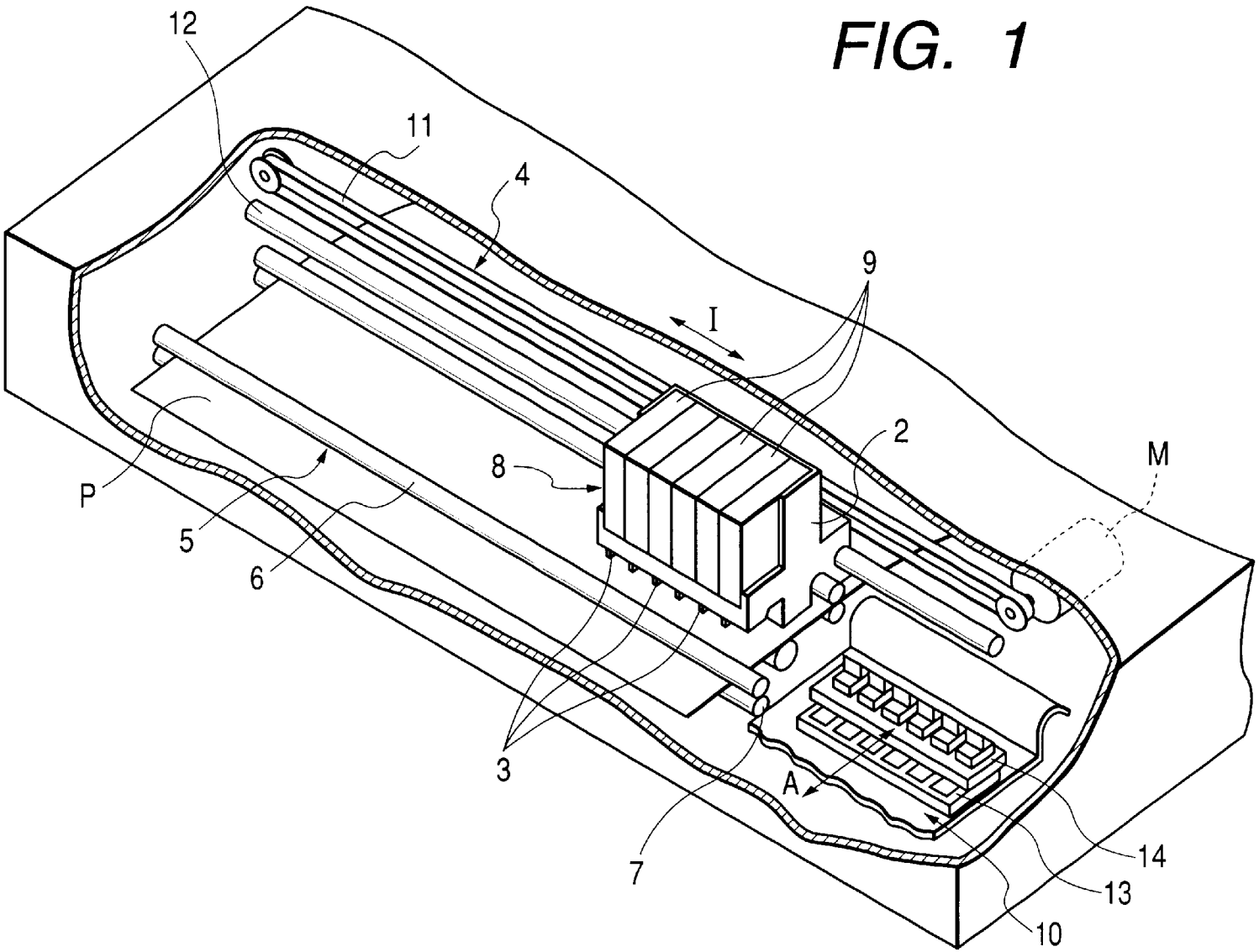
FIG. 1 is a typical perspective view showing an embodiment of an ink jet recording apparatus as a liquid discharging apparatus to which the present invention is applied.

Some embodiments of the present invention will hereinafter be specifically described with reference to the drawings. FIG. 1 is a typical perspective view showing an embodiment of an ink jet recording apparatus as a liquid discharging apparatus to which the present invention is applied. In FIG. 1, a recording medium (recording paper) P is conveyed (fed) by the conveying roller (paper feeding roller) 6 of a conveying mechanism (paper feeding mechanism) 5, and on a platen (in the shown embodiment, a platen roller) 7, liquid (ink) is discharged from recording means (recording head) 3 as liquid discharging means on the basis of discharge information (such as recording information), whereby predetermined image formation (recording) is effected on the recording medium P. In the shown embodiment, the recording means is comprised of a plurality of recording heads 3 for discharging different inks, and these recording heads 3 are positioned and carried on a carriage 2. The plurality of discharging heads (recording heads) 3 are connected to ink tanks 9 filled with the inks corresponding thereto. In the shown embodiment, use is made of a plurality of (six) cartridges 8 for recording by the use of different inks, and each cartridge 8 is of a construction in which a recording head (recording means) 3 and an ink tank 9 are made integral with each other, and is interchangeably carried.

The carriage 2 is supported for reciprocal movement in the directions of double-headed arrow I along a guide shaft 12 installed in the main body of the apparatus. This carriage 2 is connected to the driving belt 11 of a carriage driving mechanism 4, and is driven along the guide shaft 12 by the driving force of a carriage motor M. Accordingly, the carriage 2 is reciprocally moved along the guide shaft 12 by the forward rotation and reverse rotation of the carriage motor M, and has its position and movement (movement in the main scanning direction) controlled by the rotation of the carriage motor M being controlled. Also, the conveyance (feeding, sub-scanning) of the recording paper (recording medium) P is effected by the conveying roller 6 of the conveying mechanism 5 being driven by a conveying motor, not shown, through a transmission mechanism, not shown.

The recording head (recording means) 3 as the liquid discharging means (liquid discharging head) is ink jet recording means for discharging ink by the utilization of heat energy, and is provided with an electrothermal converting element for generating heat energy. Also, the recording head 3 discharges the ink from a discharge port and effects recording by the utilization of a pressure change (state change) caused by the growth and contraction of a bubble by film boiling created by the heat energy applied by the electrothermal converting element.

Figure 2:
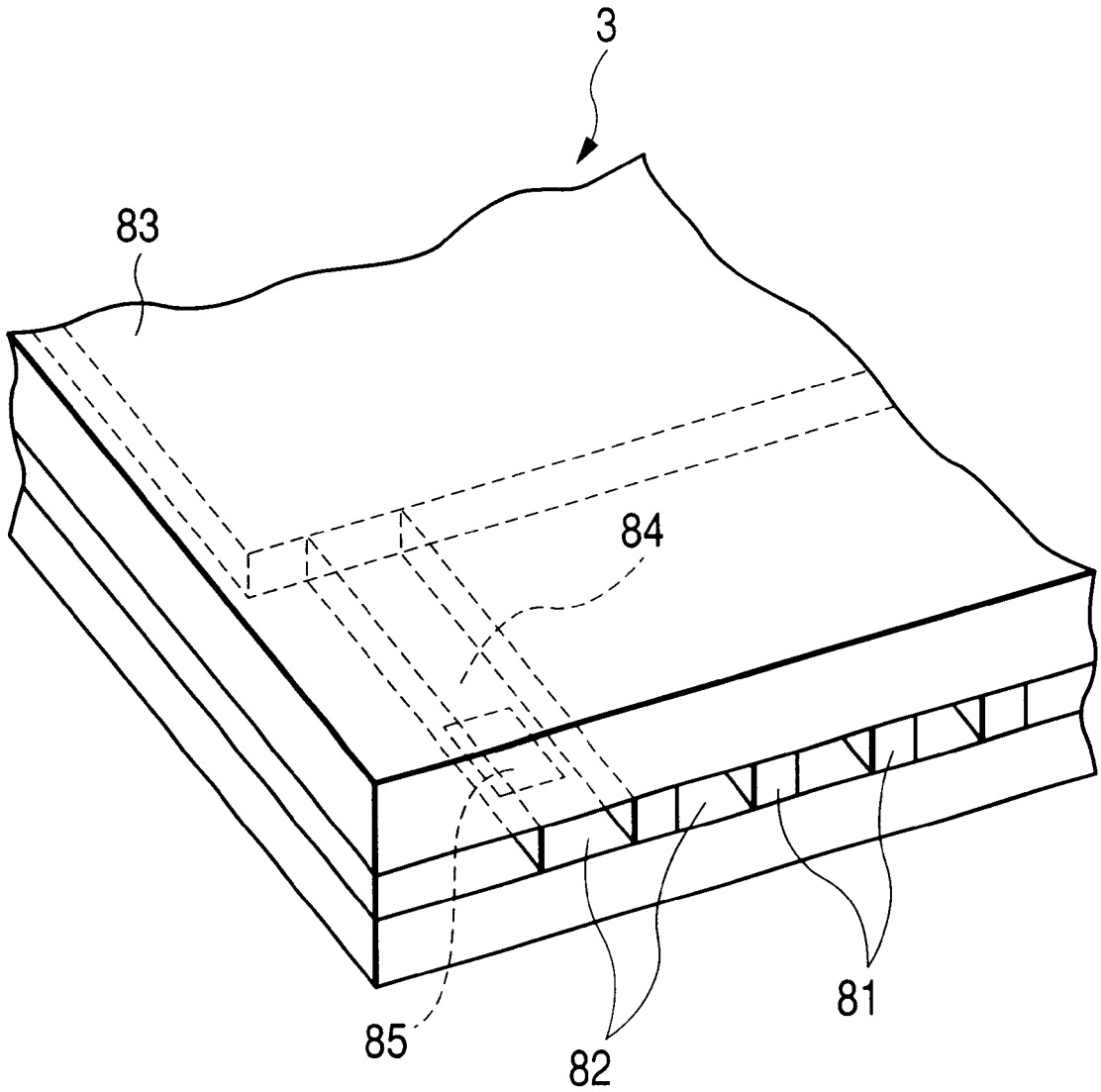
FIG. 2 is a fragmentary perspective view typically showing the structure of the ink discharging portion of a recording head as discharging means in FIG. 1.

FIG. 2 is a fragmentary perspective view typically showing the structure of the ink discharging portion of the recording head 3. In FIG. 2, a discharge port surface 81 facing the recording medium P such as paper with a predetermined gap (e.g. about 0.3–2.0 mm) therebetween is formed with a plurality of discharge ports 82 at a predetermined pitch, and an electrothermal converting element (such as a heat-generating resistance element) 85 for generating energy for ink discharge is disposed along the wall surface of each liquid path 84 communicating each discharge port 82 with a common liquid chamber. In the present embodiment, the recording head 3 is carried on the carriage 2 in such positional relationship that the discharge ports 82 are arranged in a direction intersecting with the scanning direction of the carriage 2. Thus, the recording head 3 is designed such that a corresponding electrothermal converting element 85 is driven (electrically energized) on the basis of an image signal or a discharge signal to thereby film-boil the ink in the liquid paths 84 and the ink is discharged from the discharge ports 82 by pressure generated at that time.

In FIG. 1, at a predetermined location within the movement range of the carriage 2 and off the recording area (for example, a location corresponding to the home position of the carriage 2), there is disposed a recovery system (recovery device) 10 for maintaining and recovering the ink discharging performance of the recording heads 3 during the standby of the recording operation or before and after the recording operation or at suitable timing during the recording operation. This recovery system 10 is provided with a cap 13 for capping the discharge port surface 81 of the recording heads 3 located at the home position, a suction pump (the tube pump of FIG. 3) as a negative pressure generating source connected to the cap 13, wiping means comprising a wiper 14 for wiping the discharge port surface 81 of the recording heads 3, etc. The wiper 14 is usually formed as a plate-shaped rubber-like elastic member (blade).

When the recovering operation for maintaining and recovering the ink discharging performance of the recording heads 3 is to be performed by the recovery system 10, there is performed the suction recovery operation of operating the suction pump with the cap 13 brought into close contact with the discharge port surface 81 to cap the discharge ports 82 to thereby suck the inks from the discharge ports 82, and discharging foreign materials such as viscosity-increased inks and bubbles with the inks to thereby restore the inks in the discharge ports to their normal state. Also, with or instead of this suction recovery operation, there is performed the discharge recovering operation of forcibly discharging the inks from the discharge ports 82 toward the cap 13 or other liquid receiver (not shown) by pressurizing means provided in an ink supply path or the like to thereby remove the viscosity-increased inks, bubbles, etc. in the ink flow paths of the recording heads 3.

Further, provision is made of wiping means for wiping off the liquid (such as inks) and foreign materials such as adhering substances adhering to the discharge port surface 81 of the liquid discharging heads 3 by the wiper 14. This wiping operation is performed, for example, by wiping the discharge port surface 81 including the discharge ports 82 by the wiper 14 after a period during which the liquid discharging means is not used has elapsed for a predetermined time after a predetermined amount of liquid has been discharged, or after the sucking operation for removing bubbles and dust in the liquid discharging means has been executed. As this wiping operation, use is made of not only the wiping operation performed simply by rubbing the wiper 14 against the discharge port surface 81, but the wiping operation performed by applying such a degree of pulse that the ink is not discharged to each discharge port 82 and warming the ink in the discharge port (the wiping method of drawing out warm ink during wiping to thereby wet the discharge port surface with the warm ink and enhance the cleaning effect), or the wiping operation of rubbing the discharge port surface while discharging the ink from discharge ports within a predetermined range during wiping (preliminary discharge), or a wiping operation comprising a suitable combination of these.

So, the liquid discharging apparatus according to the present invention is characterized by a mounting portion for mounting thereon a liquid discharging head provided with a discharge port for discharging liquid therethrough, a cap for covering the discharge port, suction means for effecting suction from the discharge port when the cap covers the discharge port, and control means for causing the cap to cover the discharge port when the liquid discharging head is mounted on the mounting portion, and causing the suction means in this state to effect first suction for effecting suction from the discharge port by negative pressure having a first negative pressure curve indicative of the relation between the negative pressure in the cap for suction and the time elapsed, and then causing the suction means to effect second suction for effecting suction from the discharge port by negative pressure in a second negative pressure curve small in the frequency of occurrence of the peak of the negative pressure per unit time as compared with the first negative pressure curve with the cap caused to cover the discharge port.

In the liquid discharging apparatus of the above-described construction, it is preferable to make it into a construction further having a wiper for wiping the discharge port after the second suction, and prohibiting means for prohibiting the shift to the wiping by the wiper after the first suction, a construction in which the first suction is for substituting liquid containing a coloring material for liquid containing no coloring material filling the liquid discharging head, a construction in which the liquid discharging head is a liquid discharging head provided with a electrothermal converting element for generating heat energy utilized to discharge the liquid, or a construction in which the liquid discharging head discharges the liquid from the discharge port by the utilization of film boiling caused in the liquid by heat energy generated by the electrothermal converting element.

The discharge recovering method for the liquid discharging apparatus according to the present invention is characterized by the first sucking step of effecting, when a liquid discharging head provided with a discharge port for discharging liquid therethrough is mounted on a mounting portion for mounting the liquid discharging head thereon, suction from the discharge port by negative pressure in a first negative pressure curve indicative of the relation between the negative pressure in a cap for suction and the time elapsed with the cap covering the discharge port, and the second sucking step of effecting, after the first sucking step, suction from the discharge port by negative pressure having a second negative pressure curve small in the frequency of occurrence of the peak of the negative pressure per unit time as compared with the first negative pressure curve with the discharge port covered with the cap.

In the discharge recovering method of the above-described construction for the liquid discharging apparatus, it is preferable to make it into a construction further comprising the wiping step of wiping the discharge port by a wiper after the second sucking step, and in which the shift to the wiping step after the first sucking step is prohibited, or a construction in which the first sucking step is for substituting liquid containing a coloring material for liquid containing no coloring material filling the liquid discharging head.

Figure 3:
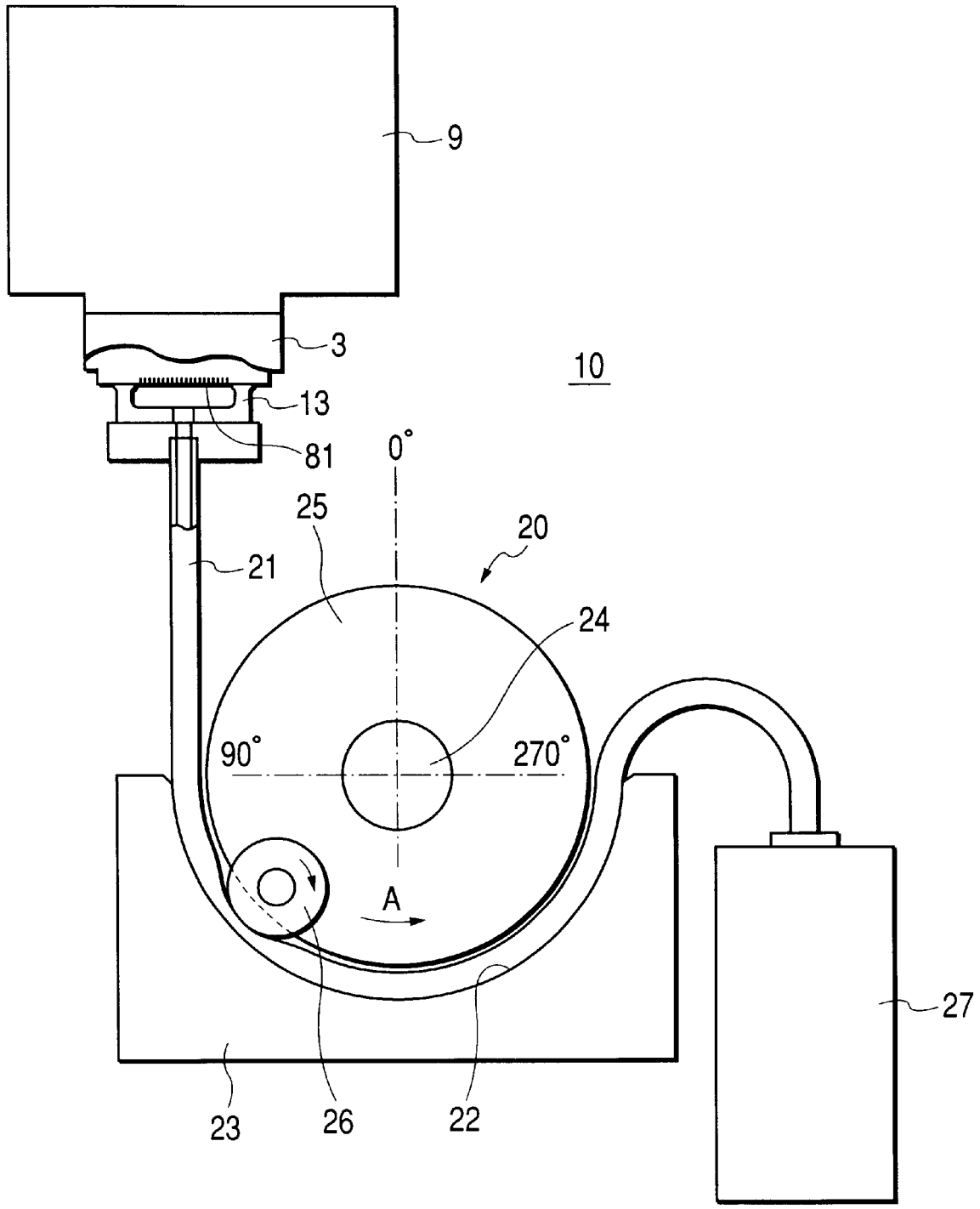
FIG. 3 is a typical view showing the construction of suction means including the suction pump of a recovery system in an embodiment of the liquid discharging apparatus to which the present invention is applied.

FIG. 3 is a typical view showing the construction of suction means including the suction pump 20 of the recovery system 10 in an embodiment of the liquid discharging apparatus to which the present invention is applied. FIG. 3 shows a state (capping state) in which the discharge port surface 81 of the liquid discharging head (ink jet head) 3 is covered with the cap 13. Also, the interior of the head 3 carried on the carriage 2 is communicated with the interior of the ink tank 9 and thus, when the liquid in the head 3 is decreased, the ink in the ink tank 9 is automatically supplied into the head.

In FIG. 3, the cap 13 is connected to the suction pump 20 through an ink tube 21. This suction pump 20 is comprised of a tube pump. That is, the tube pump 20 is provided with a tube guide 23 for guiding the ink tube 21 formed of a rubber-like elastic material along an arcuate groove 22, a disc-shaped runner holder 25 rotatively drivable through a driving shaft 24 rotatably journalled at a concentric position in the arcuate groove 22, and a pressurizing runner 26 rotatably journalled on the runner holder 25 in such positional relationship as to crush the tube 21 backed up by the arcuate groove 22. The runner holder 25 is rotatively driven in the direction of arrow A by the driving shaft 24 with the time when the runner is in its uppermost position as an angle of rotation of 0 degree. The arcuate groove 22 of the tube guide 23 is formed over a range of the angle of rotation of e.g. about 90 degrees to about 270 degrees (approximately a semicircular shape).

Accordingly, the tube 21 formed of a rubber-like elastic material is adapted to be crushed and closed when the pressurizing runner 26 lies within the range of an angle of rotation of about 90 degrees to an angle of rotation of about 270 degrees in which it is opposed to the arcuate groove 22, and to restitute and be opened when the pressurizing runner 26 lies within the range of an angle of rotation of 0 degree to an angle of rotation of about 90 degrees and the range of an angle of rotation of about 270 degrees to an angle of rotation of 360 degrees in which it is off the arcuate groove 22. That is, the tube 21 is crushed and squeezed by the rotation of the runner holder 25 during the time when the pressurizing runner 26 passes the location opposed to the tube guide 23, and the crushing of the tube 21 is released to thereby open the tube 21 during the time when the pressurizing runner 26 passes the location off the tube guide 23. Design is made such that negative pressure is created in the interior of the tube 21 adjacent to the cap 13 (adjacent to the head 3) by the squeeze of the pressurizing runner 26, and the liquid is sucked from the discharge ports 82 of the head 3 through the cap 13. The distal end of the tube 21 is connected to a waste ink reservoir 27, and the sucked liquid is introduced into this waste ink reservoir.

Figure 4:
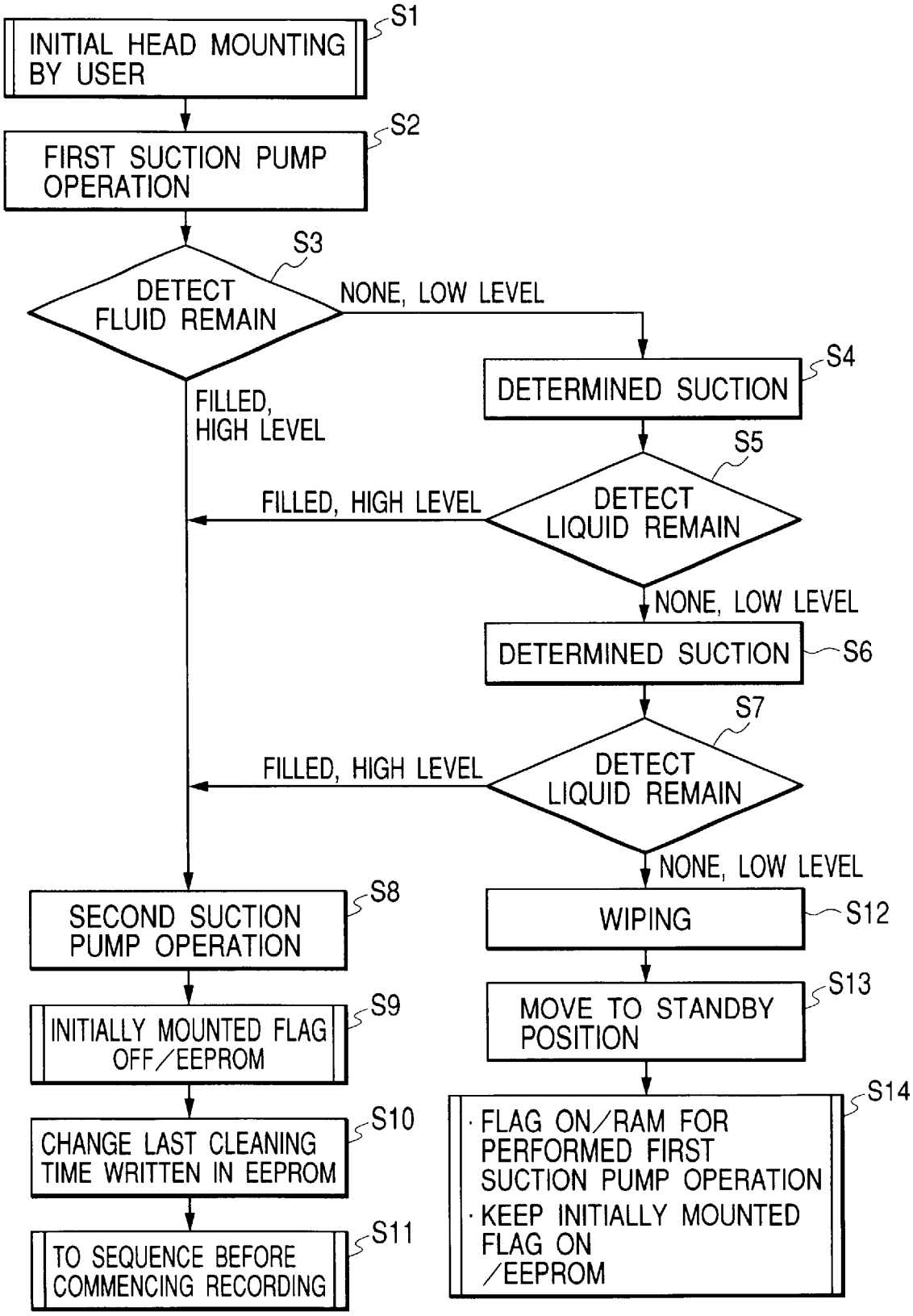
FIG. 4 is a flow chart showing an example of the discharge recovering operation sequence when a liquid discharging head is mounted in a liquid discharging apparatus according to the present invention.

FIG. 4 is a flow chart showing an example of the operation sequence (the initial shipping time sequence and the initial cleaning sequence) when discharge recovery is executed when the liquid discharging head is mounted in the liquid discharging apparatus according to the present invention. In FIG. 4, when at a step S1, the user initially mounts the head 3, at a step S2, the first suction pump operation as first suction (the first sucking step) is performed. In this case, the liquid discharging head 3 is positioned and mounted, for example, at a predetermined location on the carriage 2, and the interior of the head 3 is filed with clear ink (liquid) subsequently to the shipment. Also, the interior of the head 3 is communicated (connected) with the interior (ink) of the ink tank 9, and when the liquid in the head 3 is decreased, the liquid in the ink tank 9 flows (is supplied) into the head by an amount corresponding to the decrease. Also, as the clear ink, use is made of liquid containing no coloring material and having components similar to those of ink.

Impurities such as additives dissolved from liquid contacting materials such as a sealant and an adhesive agent during shipment are sometimes mixed with the liquid (the clear ink or the like) filling the interior of the head 3, and if these impurities adhere to the discharge port surface 81, the wiper blade 14, etc. and mix with the recording ink, the quality of image recording may be lowered. So, the above-mentioned first suction is the suction pump operation for ensuring the density of such impurities dissolved during shipment to assume a threshold value or less. This first suction is effected in a pump sequence (see FIG. 5) which can shorten to the utmost the time for which the liquid (liquid containing the impurities, etc.) touches the discharge port surface 81 of the liquid discharging head 3. Also, at the first sucking step, the shift to the wiping operation is prohibited so that the liquid (liquid containing impurities, etc.) may not touch the wiper blade 14.

Figure 7:
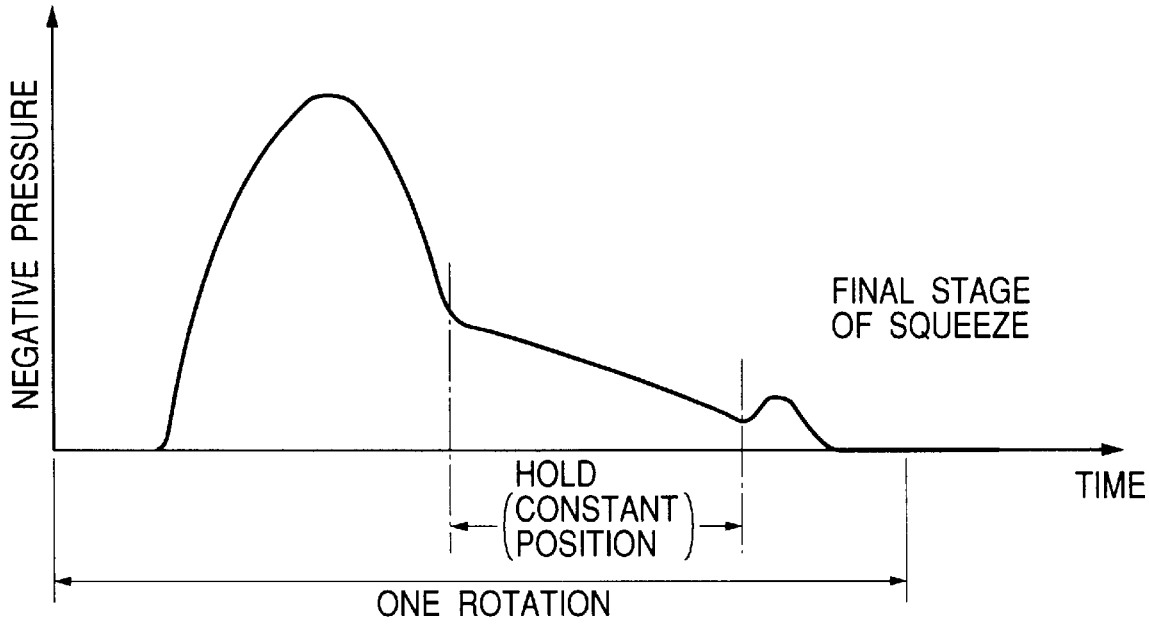
FIG. 7 is a graph showing a second negative pressure curve of second suction in the present invention.

After the first suction has been terminated, at a step S3, the amount of remaining liquid in the head 3 is detected. This detection of the amount of remaining liquid is for confirming whether the ink tank 9 filled with the ink is reliably connected. If the amount of remaining liquid detected at the step S3 is a low level or none, advance is made to a step S4, where determined suction is effected, and the amount of remaining liquid in the head 3 is detected again. The aforementioned determined suction is intended to remove small bubbles present in the ink in the head 3 which may cause an error in the aforementioned detection of the amount of remaining liquid. That is, the operation of determined suction may suitably be one exhibiting a negative pressure curve as shown in FIG. 7 which sufficiently takes the bubble removing property into account, and it is desirable that the amount of suction be as small as possible. However, if the removal of small bubbles is accomplished, it may be the same sucking operation as the aforedescribed first suction, or may be an operation similar to that during ordinary suction recovery, or further may e set to other suitable operation. If also at a step S5, the detected amount of remaining liquid is a low level or none, advance is made to a step S6, where determined suction is effected again, and at a step S7, the amount of remaining liquid in the head 3 is detected once again. The reason why the determined suction is thus repeated twice is for confirming that the mounted head 3 is connected to the ink tank 9 and the ink tank 9 is sufficiently filled with the ink.

If at the step S3, S5 or S7, it is detected that the amount of remaining liquid is a high level or full, wiping is not effected, but advance is made to a step S8, where the second suction pump operation as second suction (the second sucking step) is performed. That is, the liquid discharging apparatus according to an embodiment of the present invention is provided with prohibiting means for prohibiting the shift to the wiping operation by the wiper for wiping the discharge port surface 81 after the first suction (sucking step). The second suction pump operation is performed in accordance with a pump sequence (see FIG. 7) used in the ordinary suction recovering operation which sufficiently takes the bubble removing property or the like into account.

When the second suction of the step S8 is terminated, at a step S9, the initial mounted flag (flag on EEPROM) of the liquid discharging head 3 is rendered OFF, and then advance is made to a step S10, where the last cleaning time written in the EEPROM is changed, and at a step S11, advance is made to the sequence before commencing image recording. On the other hand, if also at the detection of the amount of remaining liquid at the step S7, the amount of remaining liquid is a low level or none, advance is made to a step S12, where the discharge port surface 81 of the head 3 is wiped by the wiper 14, and at a step S13, the liquid discharging head 3 is moved to a standby position, and advance is made to a step S14, where a flag for the performed first suction pump operation is rendered ON on a RAM and also the initially mounted flag on the EEPROM is kept ON, thus terminating a series of operations.

Figure 5:
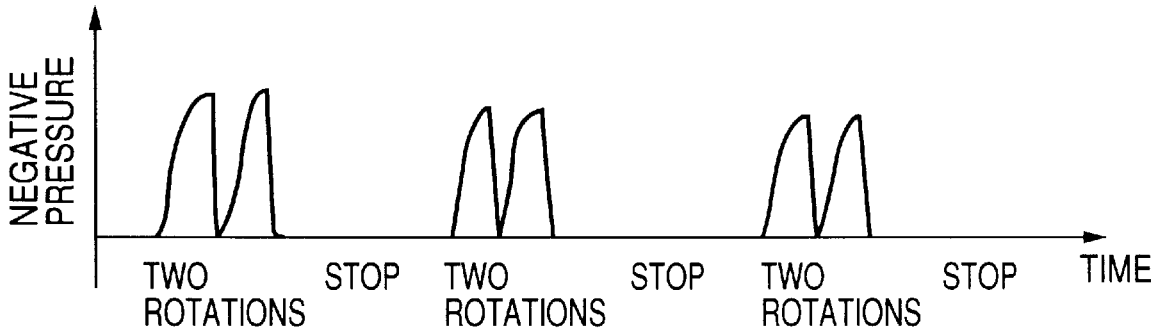
FIG. 5 is a graph showing a first negative pressure curve of first suction in the present invention.

In the present embodiment, each suction pump operation as the aforementioned suction (sucking step) is performed by a suction recording mechanism comprising the tube pump of FIG. 3. FIG. 5 is a graph showing a negative pressure curve (first negative pressure curve) in the first suction pump operation as the first suction (first sucking step), and the first negative pressure curve of FIG. 5 is indicative of the relation between the magnitude (axis of ordinates) of the negative pressure in the cap 13 and the lapse time (axis of abscissas). In FIG. 5, when the liquid discharging head 3 is mounted on the mounting portion of the liquid discharging apparatus, the cap 13 is caused to cover the discharge ports 82, and in this state, the suction means (tube pump) 20 is caused to perform the first suction for effecting suction from the discharge ports 82 by the negative pressure having the first negative pressure curve as shown in FIG. 5 indicative of the relation between the negative pressure in the cap for suction and the lapse time.

The above-described first suction is performed by causing the runner holder 25 to make two rotations in the direction of arrow A, and then stopping the runner holder 25. This "stop" is accomplished by the pressurizing runner 26 being stopped in a state in which it does not crush the tube 21 (a state in which the interior of the tube is opened to the atmosphere), that is, a state in which the pressurizing runner 26 is in a position of an angle of rotation of about 270 degrees to 360 degrees in which it is off the tube guide 23 and does not press the tube 21, and the tube 21 is opened. Accordingly, by the two rotations of the runner holder 25, the tube 21 is squeezed twice, whereby the negative pressure as indicated by the curve of the left two crests in FIG. 5 is generated in the tube 21, and by this negative pressure, the liquid is drawn out of the head 3. When the amount of liquid in the head 3 is decreased by this drawing-out of the liquid, ink is supplied into the head 3 from the ink tank 9 connected thereto, and the density of the liquid drawn out of the head 3 is diluted by the ink, and the density of impurities (such as additives dissolved into the liquid in the head during shipment) in the liquid (including the ink) drawn out is also lowered.

Figure 6:
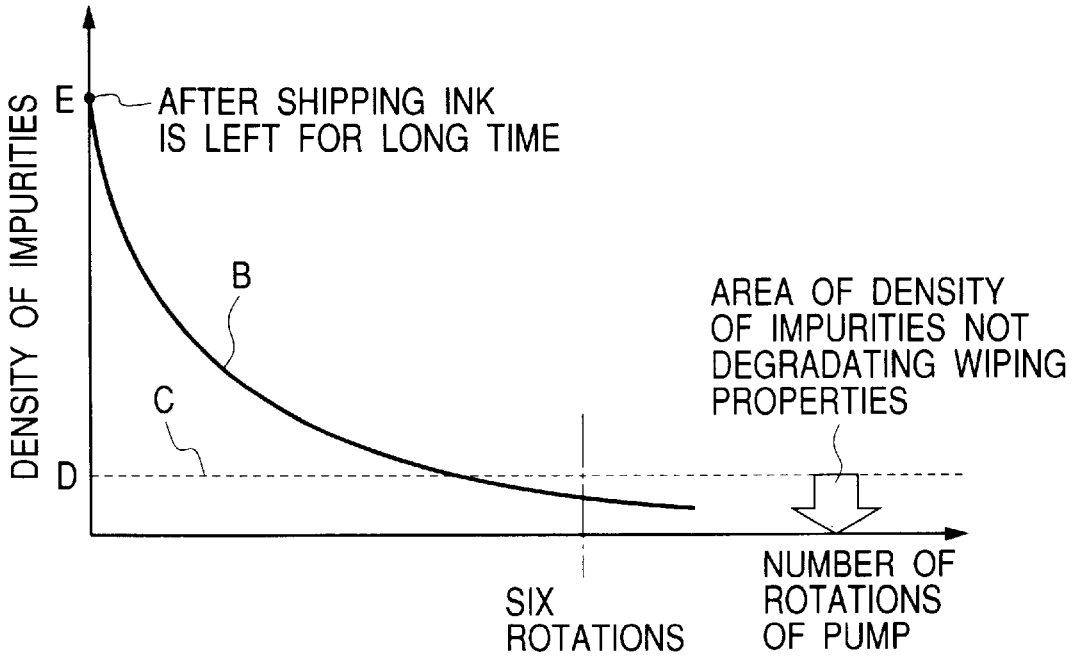
FIG. 6 is a graph illustrating changes in the density of impurities in the liquid in the head in the first suction shown in FIG. 5 relative to the frequency of operations of suction means.

The first suction shown in FIG. 5 is constituted by the pump sequence of repeating the "generation of negative pressure" and "stop" as described above three times in all. FIG. 6 is a graph illustrating a density change (curve B) in the above-mentioned impurities in the liquid drawn out of the head 3 when the first suction as shown in FIG. 5 is effected, and in FIG. 6, the axis of ordinates indicates the density of the impurities, and the axis of abscissas indicates the number of rotations of the suction pump 20 (the number of rotations of the runner holder 25). Also, in FIG. 6, the density D of the impurities indicates the maximum value (threshold value) of the density area of the impurities which does not deteriorate the wiping property, and the density E of the impurities indicates the density of the impurities after the shipping ink is left for a long time. In the shown example, if as shown in FIG. 5, the suction pump 20 is rotated 6 times in all, there is obtained a pump sequence (an amount of suction) which ensures the density of the impurities dissolved during shipment to assume the threshold value (density D) or less. In the applicant's test, it has been found that the gradient of the density change curve (curve B) of the impurities in FIG. 6 is scarcely changed even if the operating speed of the suction pump 20 is changed.

FIG. 7 is a graph showing the negative pressure curve (second negative pressure curve) in the second suction pump operation as the second suction (second sucking step), and the second negative pressure curve of FIG. 7 also shows the relation between the magnitude (the axis of ordinates) of the negative pressure in the cap 13 and the time elapsed (the axis of abscissas). In FIG. 7, with the cap 13 caused to cover the discharge ports 82 after the first suction has been terminated, the suction means (suction pump) 20 is caused to effect the second suction for effecting suction from the discharge ports 82 by the negative pressure in the second negative pressure curve (FIG. 7) small in the frequency of occurrence of the peak of the negative pressure per unit time as compared with the first negative pressure curve (FIG. 5).

This second suction, as shown in FIG. 7, is effected by rotating the runner holder 25 in the direction of arrow A, and positioning it within the range of about 180 degrees to about 270 degrees, and holding it in that position. This "holding" is accomplished by the pressurizing runner 26 being stopped in a state in which it has crushed the tube 21, that is, a state in which the pressurizing runner 26 has arrived at a position near the terminal of the tube guide 23 (near the trailing end of the squeeze range of the tube) and is still crushing the tube 21. Accordingly, the pressurizing runner 26 is held in the state in which it has crushed the tube 21, whereby negative pressure as indicated by the mountain-shaped curve in FIG. 7 is generated in the tube 21, and such a sufficient amount of liquid as will draw out bubbles, etc. in the head 3 is drawn out by this negative pressure. Again in this case, when the amount of the liquid (ink) in the head 3 is decreased by this drawing-out, ink is supplied into the head 3 from the ink tank 9 connected thereto, and in the meantime, the ink in the discharge ports is sufficiently refreshed. Also, in the second sucking step, a series of steps of causing the runner holder 25 to make one rotation in the direction of arrow A, and then performing the second suction pump operation, and thereafter effecting wiping twice are repeated twice, whereafter the second suction pump operation is performed and wiping is effected once. Thereby, among bubbles present in the ink in the head 3, particularly those present at a location adversely affecting printing can be reliably removed to thereby sufficiently remove the stains on the discharge port surface of the head and ensure good printing.

In the embodiment described above, a case where the wiper 14 is moved along the discharge port surface 81 (recording head 3) to thereby effect wiping has been described as an example, but this also holds true in a case where the discharge port surface is moved relative to the wiper, and the wiping in the present invention is applicable to any of these cases if the wiper and the discharge port surface are moved relative to each other, and both of them are covered within the technical scope of the present invention.

Also, while in the above-described embodiment, a liquid discharging apparatus of the serial recording type which effects recording while the ink jet recording head 3 is moved relative to the recording medium (recording material) P has been described as an example, the present invention can also be equally applied to a liquid discharging apparatus of the line recording type which effects recording by only sub-scanning by the use of an ink jet recording head of the line type having a length covering the full length or a part of the recording medium, and achieves a similar effect. Also, the present invention can likewise be applied to a liquid discharging apparatus using a head, a color liquid discharging apparatus using a plurality of heads for recording in different colors, or a gradation liquid discharging apparatus using a plurality of heads for recording in the same color but at different densities, or further a liquid discharging apparatus for executing image recording by a combination of these, and can achieve a similar effect.

Further, the present invention can likewise be applied to any disposition and construction of the head and the ink tank such as a construction using an interchangeable ink cartridge comprising a head and an ink tank made integral with each other, or a construction in which a head and an in tank are made discrete from each other and are connected together by an ink supply tube or the like, and can obtain a similar effect. The present invention can also be applied to a case where an ink jet recording apparatus uses image recording means using an electromechanical converting element such as a piezoelectric element or the like, and particularly brings about an excellent effect in an ink jet recording apparatus using recording means of a type discharging ink by the utilization of heat energy, because according to such a type, the higher density and higher definition of recording can be achieved.

What is claimed is:

1. A liquid discharging apparatus characterized by:

a mounting portion for mounting thereon a liquid discharging head provided with a discharge port for discharging liquid therethrough;

a cap for covering said discharge port;

suction means for effecting suction from said discharge port when said cap covers said discharge port; and control means for causing said cap to cover said discharge port when said liquid discharging head is mounted on said mounting portion, and causing said suction means, in this state, to effect first suction from said discharge port by negative pressure having a first negative pressure curve indicative of a relation between the negative pressure in said cap for suction and a time interval elapsed, and then causing said suction means to effect second suction from said discharge port by negative pressure in a second negative pressure curve smaller in a frequency of occurrence of a peak of the negative pressure per unit time as compared with said first negative pressure curve with said cap caused to cover said discharge port.

2. A liquid discharging apparatus according to claim 1, further characterized by:

a wiper for wiping said discharge port after said second suction; and prohibiting means for prohibiting a shift to the wiping by said wiper after said first suction.

3. A liquid discharging apparatus according to claim 1, further characterized in that said first suction is for substituting liquid containing a coloring material for liquid containing no coloring material filling said liquid discharging head.

4. A liquid discharging apparatus according to claim 1, further characterized in that said liquid discharging head is a liquid discharging head provided with an electrothermal converting element for generating heat energy utilized to discharge the liquid.

5. A liquid discharging apparatus according to claim 4, further characterized in that said liquid discharging head discharges the liquid from the discharge port by the utilization of film boiling caused in the liquid by the heat energy generated by said electrothermal converting element.

6. A discharge recovering method for a liquid discharging apparatus comprising the steps of:

a first sucking step of effecting, when a liquid discharging head provided with a discharge port for discharging liquid therethrough is mounted on a mounting portion for mounting said liquid discharging head thereon, suction from said discharge port by negative pressure in a first negative pressure curve indicative of a relation between the negative pressure in a cap for suction and a time interval elapsed with said cap covering said discharge port; and a second sucking step of effecting, after said first sucking step, suction from said discharge port by negative pressure having a second negative pressure curve smaller in a frequency of occurrence of a peak of the negative pressure per unit time as compared with said first negative pressure curve with said discharge port covered with said cap.

7. A discharge recovering method according to claim 6, further comprising a wiping step of wiping said discharge port by a wiper during or after said second sucking step, and in that a shift to said wiping step during or after said first sucking step is prohibited.

8. A discharge recovering method according to claim 6, wherein said first sucking step is for substituting liquid containing a coloring material for liquid containing no coloring material filling said liquid discharging head.

9. A discharge recovering method for a liquid discharging apparatus comprising the steps of:

a first sucking step of effecting suction from a discharge port by negative pressure in a first negative pressure curve indicative of a relation between the negative pressure in a cap for suction and a time interval elapsed with said cap covering said discharge port; and a second sucking step of effecting, after said first sucking step, suction from said discharge port by negative pressure having a second negative pressure curve smaller in a frequency of occurrence of a peak of the negative pressure per unit time as compared with said first negative pressure curve with said discharge port covered with said cap.

* * * * *